US010358711B1

(12) United States Patent
Ajayi et al.

(10) Patent No.: US 10,358,711 B1
(45) Date of Patent: Jul. 23, 2019

(54) MECHANICAL PROCESSING OF METALLIC COMPONENT SURFACES

(71) Applicant: U.S. Department of Energy, Washington, DC (US)

(72) Inventors: Oyelayo O. Ajayi, Oswego, IL (US); Maria de la Cinta Lorenzo-Martin, Willowbrook, IL (US)

(73) Assignee: U.S. Department of Energy, Washington, DC (US)

( * ) Notice: Subject to any disclaimer, the term of this patent is extended or adjusted under 35 U.S.C. 154(b) by 269 days.

(21) Appl. No.: 15/356,695

(22) Filed: Nov. 21, 2016

(51) Int. Cl.

| | |
|---|---|
| ***C23C 8/22*** | (2006.01) |
| ***C23C 8/26*** | (2006.01) |
| ***C23C 10/32*** | (2006.01) |
| ***C23C 10/20*** | (2006.01) |

(52) U.S. Cl.
CPC ..... *C23C 8/22* (2013.01); *C23C 8/26* (2013.01); *C23C 10/20* (2013.01); *C23C 10/32* (2013.01)

(58) Field of Classification Search
None
See application file for complete search history.

(56) References Cited

U.S. PATENT DOCUMENTS

| | | | | |
|---|---|---|---|---|
| 6,638,381 | B2 | 6/2003 | Keener | |
| 8,603,571 | B2 | 12/2013 | Carlson | |
| 8,893,954 | B2 | 11/2014 | Schultz et al. | |
| 8,998,064 | B2 * | 4/2015 | Russell | B23K 20/1235 228/112.1 |
| 9,266,191 | B2 * | 2/2016 | Kandasamy | B23K 20/128 |
| 2002/0014516 | A1 * | 2/2002 | Nelson | B23K 20/122 228/112.1 |
| 2007/0138236 | A1 | 6/2007 | Agarwal | |
| 2011/0111246 | A1 * | 5/2011 | Krajewski | B22F 7/04 428/545 |
| 2012/0031249 | A1 * | 2/2012 | Morisada | B26D 1/0006 83/651 |
| 2014/0134325 | A1 * | 5/2014 | Schultz | B23K 20/1225 427/11 |

* cited by examiner

*Primary Examiner* — Colleen P Dunn
*Assistant Examiner* — Anthony M Liang
(74) *Attorney, Agent, or Firm* — Karen L. Blouin; Michael J. Dobbs; Brian J. Lally

(57) ABSTRACT

A method of mechanically processing a metallic material component is provided whereby alloying, carburizing, nitriding and boriding can be performed using a friction stir processing tool. This method for mechanically processing metallic material surfaces is cost effective, efficient and does not require specialized equipment.

20 Claims, 3 Drawing Sheets

MECHANICAL PROCESSING OF METALLIC COMPONENT SURFACES

GOVERNMENT INTERESTS

The United States Government has rights in this invention pursuant to Contract No. DE-AC02-06CH11357 between the U.S. Department of Energy (DOE) and UChicago Argonne LLC.

FIELD OF THE INVENTION

The present invention relates to the use of friction stir processing to alloy, carburize, boride, and nitride metallic material component surfaces.

BACKGROUND OF THE INVENTION

Metallic materials are processed for various engineering projects in several ways. The metallic materials may be alloyed by the addition of other elements to control functional properties. The properties that may be changed by alloying are: 1) mechanical properties such as hardness, strength, fatigue resistance; 2) chemical properties such as corrosion resistance, catalysis; 3) thermal properties such as conductivity, insulation, coefficient of expansion; 4) magnetic properties such as ferro and para magnetism; and, 5) optical properties such as color and decoration. Most alloying is done in liquid state via melting and casting. However, for many applications, the property enhancement is necessary only at the surface level.

Metallic materials may also be surface hardened via carburizing, nitriding and boriding. Carburizing is accomplished by adding carbon to the surface layer by exposing the material to a carbon rich atmosphere at an elevated temperature to allow carbon diffusion. Carburizing is done at high temperature (900° C.). For nitriding, nitrogen is diffused into the surface of steel usually from ammonia (NH3) at about 600° C. temperature for 10-40 hours duration. Boriding is accomplished by diffusing boron into the surface and forming different iron boride layers on the surface. This is usually done in various boron containing environments at 900-1000° C. for 6-25 hours duration.

However, for many applications, processing such as alloying, carburizing, nitriding and boriding is needed only on the surface layer. Processing the surface often involves special equipment such as high temperature furnace and lasers at significant cost. Accordingly there is a need for a method for mechanically processing metallic material surfaces that is cost effective, efficient and does not require specialized equipment.

SUMMARY OF THE INVENTION

According to one aspect of the invention, a method of mechanically processing a metallic material component is provided. The metallic material component is formed of a first material and has a body. The body has an engagement surface and at least one engagement zone extending inwardly from the engagement surface to a predetermined depth. The body has a component thickness that is greater than the depth of the engagement zone. The metallic component has a plurality of functional properties one of which is selected for change as the target property. Responsive to selecting the target property, a predetermined amount of a second material is selected and placed adjacent the engagement surface. A friction stir processing tool is rotated within the engagement zone. The tool has a pin and shoulder where the engagement zone has a width approximately equal to the diameter of the shoulder. The rotating tool causes the formation of a third material in the engagement zone where the third material is different than both the first and second materials.

In a further aspect of the invention, at least one trench is formed in at least a portion of the engagement zone. The trench has a first sidewall, a second sidewall opposed to the first face and a bottom face. The second material is placed in the trench.

DETAILED DESCRIPTION OF THE INVENTION

This invention concerns mechanically processing at least a portion of a metallic material component 102 in one of several ways including, but not limited to, alloying, boriding, nitriding and carburizing. A metallic material component 102 is a workpiece that has been formed of substantially metallic elements. Several functional properties are associated with each specific metallic material component 102 including mechanical, chemical, thermal, magnetic, electrical and optical properties. The method according to this invention modifies at least one functional property of the component 102 in a predetermined area.

Figure 1:
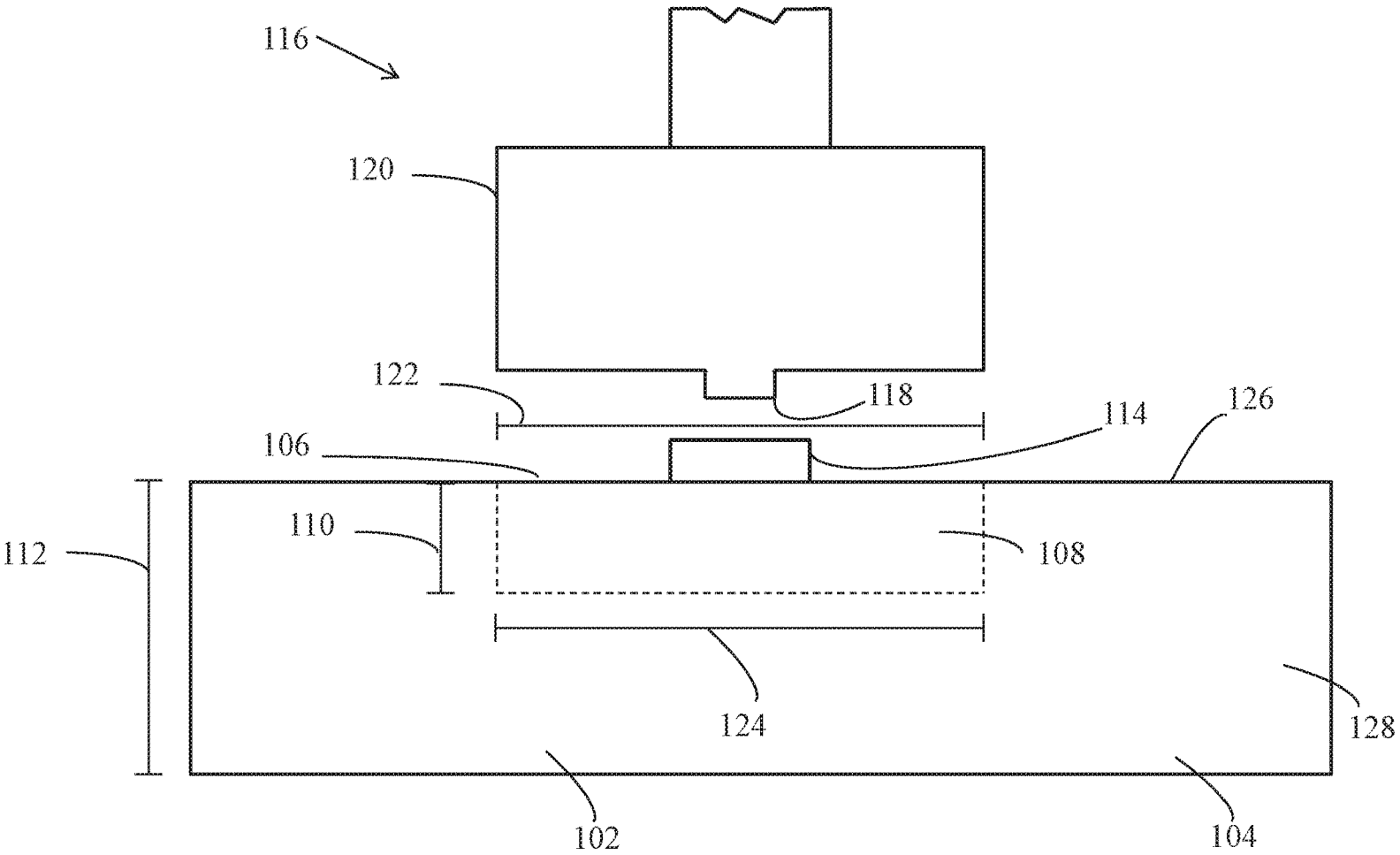
FIG. 1 is a plan view of the friction stir processing tool and metallic material component used in the method according to the invention.

In the embodiment illustrated in FIG. 1, a metallic material component 102 is formed of a first material 128. In a first embodiment the first material may be steel. In alternate embodiments the first material may be other engineering metallic materials and their alloys such as titanium, titanium alloys, zirconium, zirconium alloys, tungsten, etc. The metallic material component 102 has a body 104. The body of the metallic material component 104 has a component thickness 112 and a surface 126, a portion of which is an engagement surface 106. The engagement surface 106 is the portion of the surface of the metallic material component 126 which is mechanically processed according to the invention. An engagement zone 108 extends inwardly from and is integrally formed with the engagement surface 106. The engagement zone 108 has a predetermined depth 110 and width 124. The predetermined depth of the engagement zone 108 is less than the component thickness 112. The engagement zone 108 is the portion of the metallic material component 102 that is being mechanically processed according to the invention.

In the invention according to the method, the user determines at least one functional property of the first material 128 to be changed via the mechanical processing. The changed functional property is identified as a target property. For example, the target property may be a functional property in the following areas:

(1) Mechanical: hardness, strength, fatigue resistance;

(2) Chemical: corrosion, catalysis;

(3) Thermal: conductivity, insulation, coefficient, expansion;

(4) Magnetic: ferromagnetism, paramagnetism;

(5) Electrical: conductivity, resistivity; and, (6) Optical: color, decoration.

Responsive to identifying the target property, a second material 114 is provided such that when the component 102 is processed according to the invention, the change to the target property is achieved. For example, if the process performed is alloying, the second material 114 may be one of the following:

(1) Mechanical properties: carbon, tungsten, molybdenum, vanadium, and tantalum;

(2) Electrical properties: silver, copper, molybdenum, and nickel;

(3) Magnetic properties: silicon, cobalt, vanadium, and aluminum; and, (4) Thermal properties: copper, nickel, cobalt, and chromium.

In embodiments in which the processing is carburizing, the second material may be carbon in a solid form or a liquid form such as a carbon rich bath e.g. cyanide or a CO gas. In embodiments in which the processing is nitriding the second material may be incorporated via an ammonia or nitrogen gas environment. In embodiments in which the processing is boriding, the second material is found in a boron-rich environment or boron nanoparticles. Alternate embodiments may have second materials in different forms such that the desired result is achieved.

The second material 114 may be in the form of a solid powder, a paste, a liquid or a gas; the form or state of the second material 114 is in part determined by the specific processing. The amount or concentration of the second material 114 provided depends upon the application in which it is being used. In one embodiment the second material is a powder of nanoparticles.

The method according to the invention uses a friction stir processing tool 116 to perform the mechanical processing. Any friction stir processing tool 116 known in the art that produces acceptable results may be used. The friction stir processing tool 116 has a pin 118 and a shoulder 120. The shoulder has a first diameter 122. In one embodiment the first diameter is approximately 5-6 mm. Alternate embodiments may have first diameters of more or less than 5-6 mm. The engagement zone has a width 124 that is approximately equal to the first diameter 122, or approximately 5-6 mm in one embodiment. In a first embodiment the engagement zone has a depth 110 of 3-5 mm. In such instances, the component thickness 112 would be greater than 3-5 mm. For example if the engagement zone depth 110 is 3 mm, the component thickness 112 would be greater than 3 mm. Alternate embodiments may have engagement zone depth 110 of more or less than 3-5 mm with the component thickness 112 being greater than the engagement zone depth 110.

In operation, the second material 114 is placed so that at least a portion of the second material 114 is adjacent the engagement zone 108. The friction stir processing tool 116 is rotated within the engagement zone 108. There are several variables that can be set on the tool 116 to achieve optimal results such as the pressure, rotational speed, traveling speed and depth. The friction created between the rotating tool 116 and the metallic component 102 creates heat (in excess of 900° C.) and locally deforms the first material 128 in the engagement zone 108. The heat from the tool 116 causes the first material 128 to become plasticized. The second material 114 then gets mechanically mixed with and dissolves in the first material 128 to form a third material. The third material is different than both the first and second materials 128, 114 on an atomic level.

Figure 3:
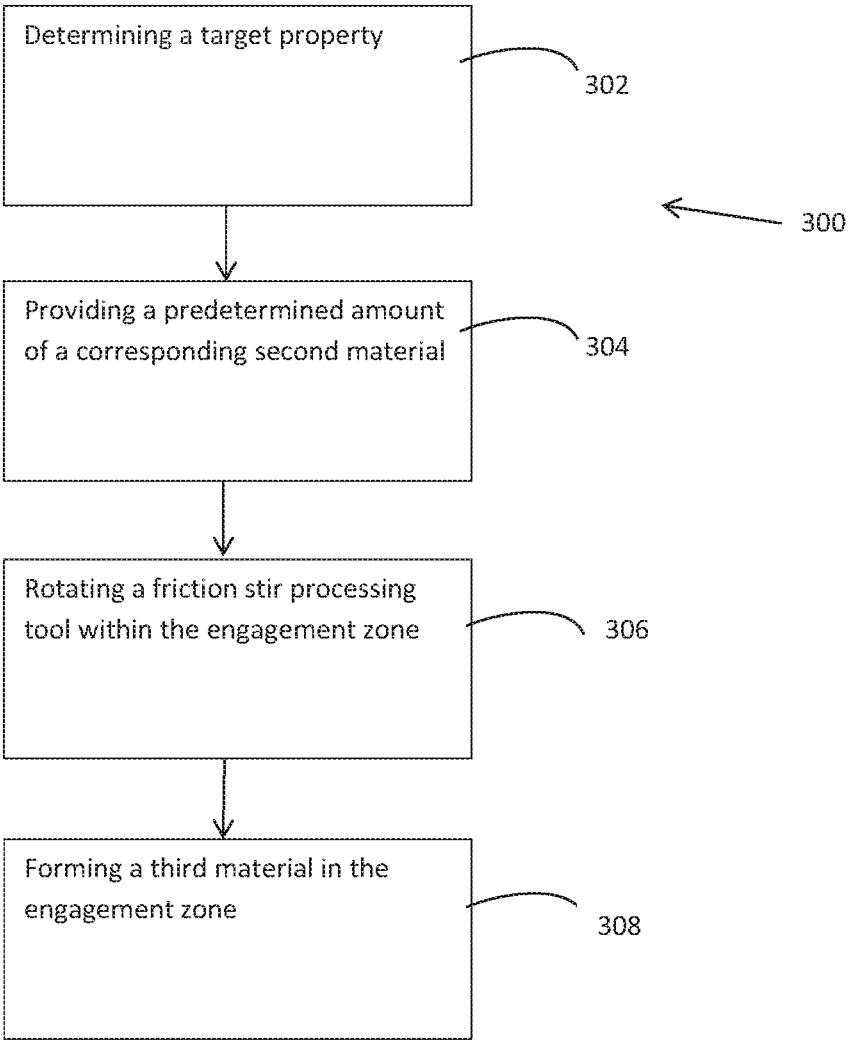

FIG. 3 is a schematic block diagram illustrating steps in the process according to the invention. In step 302 at least one target property is selected. The target property is the functional property associated with the metallic component that is to be modified by the method according to the invention. In alternate embodiments several functional properties may be modified, resulting in more than one target property.

A second material 114 is chosen based on the identified target property. The addition of second material 114 will provide the desired change in the target property. In step 304 a predetermined amount of a corresponding second material 114 is provided. The amount of the second material 114 provided is determined by the magnitude of change to the target property that is desired. The second material 114 can be provided in a predetermined concentration, particulate size, and quantity. Any amount of the second material 114 may be provided such that the desired results are achieved.

At least a portion of the second material 114 is adjacent the engagement surface 106. In one embodiment the second material 114 is a solid and the second material 114 may lie directly on the engagement surface 106. In a further embodiment, the second material 114 is contained in a gas. If the second material is contained in a gas, the first material 128 may be placed in a container or chamber with an internal space. The concentration of the gaseous second material 114 may be held at a predetermined level within the internal space. At least some of the second material gas molecules or atoms would be adjacent the engagement surface 106. In one embodiment the second material is a gas containing boron. In an alternate embodiment the second material is a gas containing carbon. In a further alternate embodiment the second material is a gas containing nitrogen. The second material in further alternate embodiments may be gases that contain elements other than boron, carbon or nitrogen such that the desired result is achieved. In each embodiment, the precise composition of the gaseous second material is determined by the user for the specific target property identified.

Figure 2:
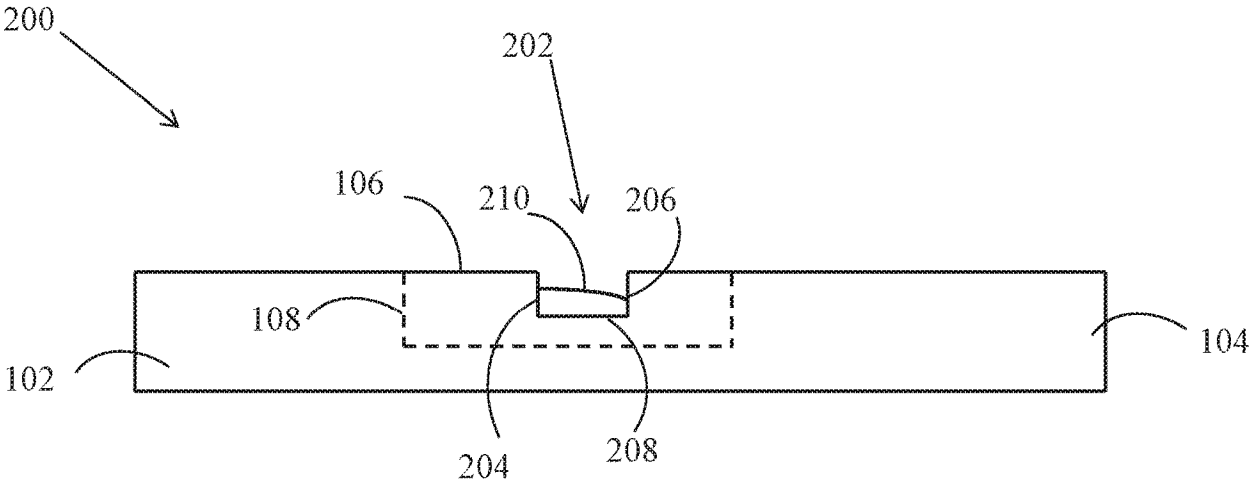
FIG. 2 is a plan view of a second embodiment of the friction stir processing tool and metallic material component used in the method according to the invention; and, FIG. 3 is a schematic flow diagram illustrating steps in a manufacturing process according to the invention.

In yet a further embodiment, a trench 202 is formed in the engagement zone 108 as illustrated in FIG. 2. The trench has a first sidewall 204, a second sidewall 206 opposed to the first sidewall 204, and a bottom face 208. The first and second sidewalls 204, 206 extend from the bottom face 208 to the engagement surface 106. The trench 202 may be of any dimensions such that it is fully contained within the engagement zone 108. In this embodiment the second material 114 is placed in the trench 202. In alternate embodiments the trench 202 may be curved or formed in a different shape than the shape illustrated in FIG. 2.

A friction stir processing tool 116 is rotated within the engagement zone 108. The user determines the rotational speed, the speed at which the tool travels along the engagement surface 106, the pressure applied by the tool 116 and any other tool specific variables.

The friction stir processing tool 116 is rotated within the engagement zone 108 thereby forming a third material within the engagement zone 108. The third material is different than both the first and second materials 128, 114 at an atomic level. In one embodiment the third material demonstrates an interstitial incorporation in the crystal lattice structure of the first material 128 whereby at least a portion of the interstitial sites of the first material molecules or atoms have been occupied by the second material molecules or atoms to form an interstitial solid solution. In an alternate embodiment the third material demonstrates atomic substitution in the crystal lattice structure whereby at least a portion of the first material atoms have been replaced with second material atoms to form a substitutional solid solution.

Example One: Alloying

In one embodiment a chromium alloying element is incorporated into the surface layer of a 1020 plain carbon steel to create a corrosion resistant stainless steel layer on top of the plain carbon steel. Chromium nanoparticles are place into the trenches 202. The friction stir processing tool 116 passes along the trenches 202. Multiple passes are accomplished to ensure adequate mixing and dissolution of the chromium in the 1020 steel matrix.

There are several advantages to using the method according to this invention over prior art methods for alloying. The method according to this invention is simpler, safer, costs less, and is more versatile. Because it is a solid state process, compositional and microstructural inhomogeneity is eliminated. Grain refinement resulting from the severe plasticity of the method according to this invention will further enhance the properties of interest. In addition there is no solubility restriction—the new process can be used to alloy materials that are thermodynamically incompatible and unalloyable by the melt process. The method according to this invention is superior to coatings because there is no distinct interface which ensures reliability and durability.

Example Two: Carburizing, Nitriding and Boriding

In a further embodiment, the method according to this invention involves the mechanical mixing of materials and elements into the processed steel layer. For carburizing, copious amounts of carbon atoms are incorporated into the steel surface. The carbon is supplied via a carbon rich environment or with carbon nano particles added to the surface. In nitriding, the nitrogen is incorporated into the surface layer by processing in an ammonia or nitrogen gas environment. Boriding is accomplished by incorporating controlled boron atoms into the surface by processing with boron nanoparticles or in a boron rich environment. Carbonitriding, carbo-boriding and other combinations of the three elements are possible through friction stir processing environment control.

Carburizing, nitriding and boriding using the method according to this invention process is faster (minutes v. hours) than prior art methods. This method uses approximately 5% of the energy of the current state-of-the-art thermal process, and allows selective and custom localized treatment and hardening. In addition, the accurate control of case depth by proper selection of friction stir processing tool and shape results in substantial grain refinement and cost savings It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

All publications and patent documents cited in this application are incorporated by reference in their entirety for all purposes to the same extent as if each individual publication or patent document were so individually denoted.

Any element in a claim that does not explicitly state "means for" performing a specified function, or "step for" performing a specific function, is not to be interpreted as a "means" or "step" clause as specified in 35 U.S.C. § 112, 6. In particular, the use of "step of" in the claims herein is not intended to invoke the provisions of 35 U.S.C. § 112, 6.

The invention claimed is:

1. A method of mechanically processing a metallic material component, the metallic material component formed of a first material, the metallic material component having a body, at least one engagement surface and at least one engagement zone extending inwardly from, and integrally formed with, the engagement surface to a predetermined depth, the body having a component thickness, the predetermined depth being less than the component thickness, the first material having a plurality of functional properties, the method comprising the steps of:

a. selecting at least one target property, the at least one target property being one of the plurality of functional properties, the at least one target property having an initial state and a desired state which is different than the initial state;

b. responsive to step of selecting, providing a predetermined amount of a corresponding second material, at least a portion of the second material disposed adjacent the engagement surface;

c. rotating a friction stir processing tool within the engagement zone, the tool having a pin and a shoulder, the shoulder having a first diameter, the engagement zone having an engagement zone width, the engagement zone width approximately equal to the first diameter;

d. responsive to said step of rotating, forming an interstitial solid solution phase in the engagement zone, the interstitial solid solution phase having a target property in the desired state.

2. The method of claim 1, wherein the step of providing further includes:

a. forming at least one trench in at least a portion of the engagement zone, said at least one trench having a bottom face, a first sidewall and a second sidewall opposed to the first sidewall, said first and second sidewalls extending from the bottom face to the engagement surface;

b. placing a predetermined amount of a second material in said at least one trench.

3. The method of claim 1, wherein the step of providing further includes:

a. placing the component in a chamber, the chamber having an internal space; and b. filling the internal space with a predetermined composition and quantity of the second material wherein the second material is a gas.

4. The method of claim 3, wherein the second material is a gas containing boron.

5. The method of claim 3, wherein the second material is a gas containing carbon.

6. The method of claim 3, wherein the second material is a gas containing nitrogen.

7. The method of claim 1, wherein the second material is a powder, the powder formed of a plurality of nanoparticles.

8. The method of claim 1, wherein the second material is a paste.

9. The method of claim 1, wherein the second material is a liquid.

10. The method of claim 1, wherein the second material is chosen from the group of silver, copper, molybdenum and nickel.

11. The method of claim 1, wherein the second material is chosen from the group of tungsten, molybdenum, vanadium, and tantalum.

12. The method of claim 1, wherein the second material is chosen from the group of silicon, cobalt, vanadium, aluminum.

13. The method of claim 1, wherein the second material is chosen from the group of copper, nitrogen, cobalt, chromium.

14. The method of claim 1, wherein the first diameter is approximately 5-6 mm.

15. The method of claim 1, wherein the predetermined depth is 3-5 mm.

16. The method of claim 1, wherein the first material is 1020 plain carbon steel.

17. The method of claim 1, wherein the first material is titanium.

18. The method of claim 1, wherein the first material is a titanium metal alloy.

19. The method of claim 1, wherein the first material is zirconium.

20. The method of claim 1, wherein the first material is a zirconium alloy.

* * * * *